US010984728B2

(12) United States Patent
Li et al.

(10) Patent No.: US 10,984,728 B2
(45) Date of Patent: Apr. 20, 2021

(54) LUMINANCE COMPENSATION METHOD, LUMINANCE COMPENSATION CIRCUIT AND DISPLAY DEVICE

(71) Applicant: Wuhan Tianma Micro-Electronics Co., Ltd., Wuhan (CN)

(72) Inventors: Jun Li, Wuhan (CN); Zhihua Yu, Wuhan (CN)

(73) Assignee: WUHAN TIANMA MICRO-ELECTRONICS CO., LTD., Wuhan (CN)

( * ) Notice: Subject to any disclaimer, the term of this patent is extended or adjusted under 35 U.S.C. 154(b) by 0 days.

(21) Appl. No.: 16/731,063

(22) Filed: Dec. 31, 2019

(65) Prior Publication Data

US 2021/0065633 A1 Mar. 4, 2021

(30) Foreign Application Priority Data

Aug. 28, 2019 (CN) ..... 201910804659.5

(51) Int. Cl.
*G09G 3/32* (2016.01)
*G09G 3/3283* (2016.01)

(52) U.S. Cl.
CPC ... *G09G 3/3283* (2013.01); *G09G 2300/0842* (2013.01); *G09G 2320/0233* (2013.01); *G09G 2330/027* (2013.01); *G09G 2360/147* (2013.01)

(58) Field of Classification Search
CPC ..... B60C 23/003; B60C 23/02; B60C 23/04; G07C 5/006
USPC ..... 345/76, 520
See application file for complete search history.

(56) References Cited

U.S. PATENT DOCUMENTS

2007/0080905 A1* 4/2007 Takahara ..... G09G 3/3258 345/76
2014/0306969 A1* 10/2014 Tang ..... G09G 5/006 345/520
2017/0162109 A1* 6/2017 An ..... G09G 3/2003
2017/0169767 A1* 6/2017 Song ..... G09G 3/3291
2018/0082634 A1* 3/2018 Wang ..... G09G 3/3233
2019/0197935 A1* 6/2019 Kim ..... G09G 3/006
(Continued)

FOREIGN PATENT DOCUMENTS

CN 105074807 A 11/2015
CN 105529002 A 4/2016
CN 107799086 A 3/2018
(Continued)

*Primary Examiner* — Tony O Davis
(74) *Attorney, Agent, or Firm* — Kilpatrick Townsend & Stockton, LLP

(57) ABSTRACT

The present disclosure discloses a luminance compensation method, a luminance compensation circuit and a display device. When a display panel starts displaying, reference compensation factors are acquired from a flash. Then the acquired reference compensation factors are stored in and RAM. Finally, a scale factor corresponding to the current to-be-displayed frame image is acquired, and the reference compensation factors corresponding to all sub-pixels and stored in the RAM are multiplied by the scale factor to generate a target compensation factor corresponding to the current to-be-displayed frame image, to enable the display panel to perform the displaying according to the target compensation factor.

19 Claims, 11 Drawing Sheets

(56) References Cited

U.S. PATENT DOCUMENTS

2020/0258468 A1* 8/2020 Chu ..... G09G 3/2003

FOREIGN PATENT DOCUMENTS

| | | | |
|---|---|---|---|
| CN | 109147668 | A | 1/2019 |
| CN | 109410892 | A | 3/2019 |
| CN | 109587468 | A | 4/2019 |
| KR | 20160084035 | A | 7/2016 |

* cited by examiner

LUMINANCE COMPENSATION METHOD, LUMINANCE COMPENSATION CIRCUIT AND DISPLAY DEVICE

CROSS REFERENCES

This application claims priority to Chinese Patent Application No. 201910804659.5, filed on Aug. 28, 2019, which is hereby incorporated by reference in its entirety.

FIELD

The present disclosure relates to the field of displaying, and particularly to a luminance compensation method, a luminance compensation circuit and a display device.

BACKGROUND

An Organic Light Emitting Diode (OLED) display panel has different threshold values due to different degrees of crystallization of low-temperature polysilicon transistors, and the entire display panel is not completely uniform in film thickness, so that mura of the display of the display panel may occur. The OLED display panel may be subjected to demura before leaving the factory.

Since demura factors corresponding to different frame rates are different, there are two methods in the related art. A display panel to display two frame rates is taken as an example.

One method is to store two sets of Demura compensation factors into a flash first, simultaneously load the two sets (such as 60 Hz and 90 Hz) of Demura compensation factors into a random access memory (RAM) in a display driver integrated chip (DDIC) when the display panel is turned on, and call different Demura compensation factors when different frame rates are displayed.

The other method is to store two sets of Demura compensation factors into a flash, acquire, by a DDIC, the Demura compensation factor corresponding to 60 Hz from the flash when 60 Hz is displayed, and load it into an RAM, erase, by the DDIC, the Demura compensation factor corresponding to 60 Hz stored in the RAM when 90 Hz is displayed, then acquire the Demura compensation factor corresponding to 90 Hz from the flash, and load it into the RAM.

In the above two methods, when the display panel is powered on each time, the DDIC downloads the Demura compensation factor from the flash and stores it in the RAM.

However, the Applicant realizes that, the above two methods have the following problems: 1, two sets of Demura compensation factors need to be stored, so that the space of the flash will be doubled, and the cost will increase; 2, the size of the RAM of the DDIC may be doubled, which causes both the size and the cost of the DDIC to be increased; and 3, during switching of frame rates, since a Demura compensation factor needs to be reloaded, the flow of screening off→erasing the data→reloading the data→screening on is needed, and the switching time is long; and furthermore, the screen needs to be turned off, so that the user experience is poor.

SUMMARY

In view of this, an embodiment of the present disclosure provides a luminance compensation method, a luminance compensation circuit and a display device, to solve the above problems in the related art.

Therefore, a luminance compensation method of an OLED display panel, provided by the embodiment of the present disclosure, includes: acquiring a reference compensation factor corresponding to each sub-pixel in a display panel from a flash when the display panel starts displaying, where the reference compensation factor is a corresponding luminance compensation factor when the display panel performs displaying according to a first preset frame rate; storing the acquired reference compensation factor corresponding to each sub-pixel into a random access memory (RAM); acquiring a scale factor corresponding to a current to-be-displayed frame image, and multiplying the reference compensation factor corresponding to each sub-pixel stored in the RAM by the scale factor to generate a target compensation factor corresponding to the current to-be-displayed frame image, to enable the display panel to perform the displaying according to the target compensation factor.

Correspondingly, an embodiment of the present disclosure further provides a display device, including an OLED display panel and any one of the luminance compensation circuit provided by the embodiments of the present disclosure.

DETAILED DESCRIPTION OF THE EMBODIMENTS

Figure 1:
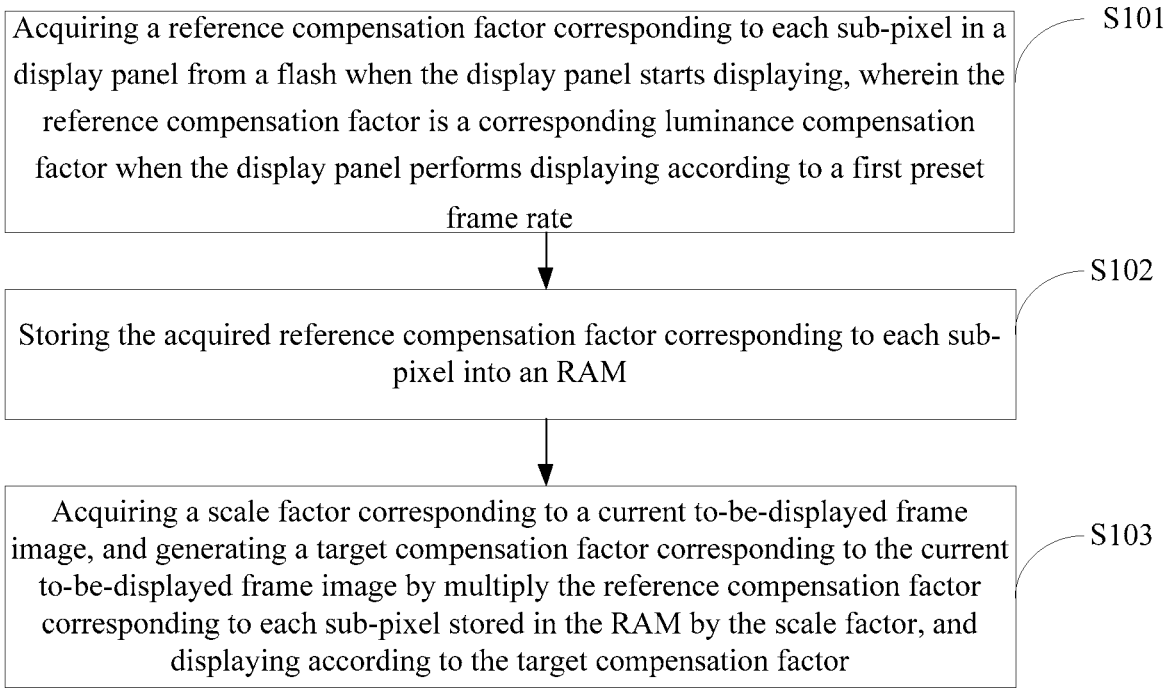
FIG. 1 is a flow diagram of a luminance compensation method provided by one embodiment of the present disclosure.

A luminance compensation method of an OLED display panel, provided by an embodiment of the present disclosure, is as shown in FIG. 1. FIG. 1 is a flow diagram of the luminance compensation method provided by one embodiment of the present disclosure. The luminance compensation method includes following operations.

S101, a reference compensation factor corresponding to each sub-pixel in a display panel is acquired from a flash when the display panel starts displaying. The reference compensation factor is a corresponding luminance compensation factor when the display panel performs displaying according to a first preset frame rate.

S102, the acquired reference compensation factor corresponding to each sub-pixel is stored into a random access memory (RAM).

S103, a scale factor corresponding to a current to-be-displayed frame image is acquired; the reference compensation factor corresponding to each sub-pixel stored in the RAM is multiplied by the scale factor to generate a target compensation factor corresponding to the current to-be-displayed frame image, to enable the display panel to perform the displaying according to the target compensation factor.

According to the luminance compensation method provided by the embodiments of the present disclosure, when the display panel starts the displaying, the reference compensation factor corresponding to each sub-pixel in the display panel is acquired from the flash, then the acquired reference compensation factor corresponding to each sub-pixel is stored in the RAM, and finally the scale factor corresponding to the current to-be-displayed frame image is acquired, and the reference compensation factor corresponding to each sub-pixel stored in the RAM is multiplied by the scale factor to generate the target compensation factor corresponding to the current to-be-displayed frame image, so that the display panel performs the displaying according to the target compensation factor.

By adopting the compensation method, regardless of the number of frame rates supported by the display panel, since the RAM and the flash only need to store the reference compensation factor, the size can be reduced by at least twice compared to the size in an existing driving method, and the cost may be saved.

Furthermore, during the switching of the frame rates, the target compensation factor may be obtained by only multiplying the reference compensation factor by the scale factor, without reloading Demura compensation factor, so the switching time is short, and no screen off is required.

In some embodiments, when the display panel performs displaying with different frame rates, although there is a difference in charging time at different frame rates, the reference compensation factors corresponding to the first preset frame rate may reflect mura of respective sub-pixels on the display panel. Therefore, by multiplying the reference compensation factors by the scale factors to acquire the target compensation factors corresponding to other frame rates, the mura of other frame rates may be compensated as well.

The luminance compensation method provided by the embodiment of the present disclosure acquires the target compensation factors by using the products of the reference compensation factors and the scale factors for different frame rates, and it is unnecessary to store compensation factors corresponding to all the frame rates.

Therefore, the above-mentioned luminance compensation method provided by the embodiments of the present disclosure has the following developments.

(1) It is only necessary to store one set of reference compensation factors, which may save the space of a flash IC and save the cost.

(2) It is only necessary to store one set of reference compensation factors, which may save the RAM space of a display driver integrated chip (DDIC) and save the cost.

(3) For each display panel, it is only necessary to complete capturing of the compensation factors at one frame rate to improve the mura effect at multiple rates, which may save the production time of a production line, and increase the product competitiveness.

(4) During switching of the frame rates, it is not necessary to reload compensation factors, and no screen off is needed, which may improve the user experience.

(5) This solution may support switching at a plurality of frame rates, is not limited to the sizes of the flash IC and the RAM, and is more flexible.

The above-mentioned luminance compensation method provided by the embodiment of the present disclosure is described in detail below through some embodiments.

In some embodiments, the scale factor corresponding to the current to-be-displayed frame image may be acquired through various methods. Three different methods will be introduced below. Of course, in specific implementation, other methods may also be included, and there is no limitation herein.

Figure 2:
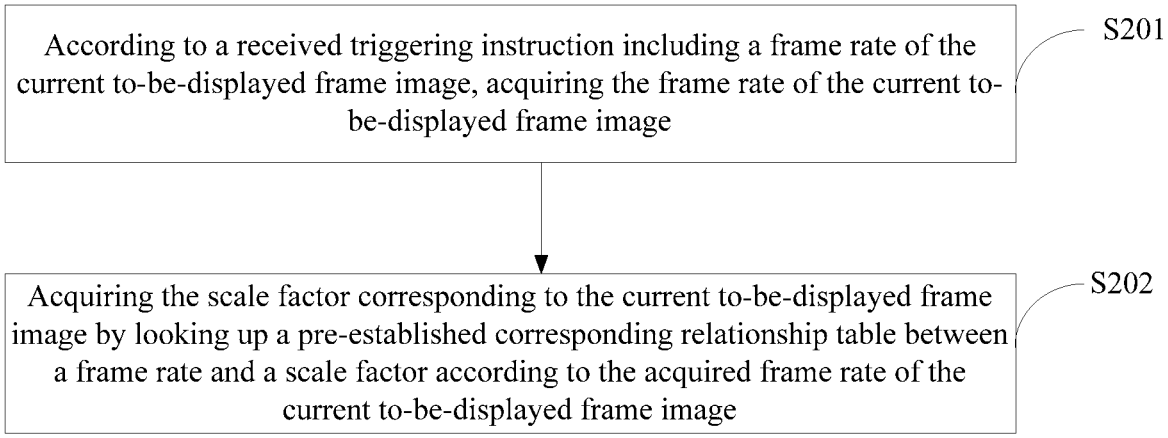
FIG. 2 is a schematic flow diagram of acquiring a scale factor corresponding to the current to-be-displayed frame image provided by one embodiment of the present disclosure.

In an optional embodiment, in the luminance compensation method provided by the embodiment of the present disclosure, the process of acquiring the scale factor corresponding to the current to-be-displayed frame image is as shown in FIG. 2.

FIG. 2 is a schematic flow diagram of acquiring the scale factor corresponding to the current to-be-displayed frame image provided by one embodiment of the present disclosure, including the following operations.

S201, a frame rate of the current to-be-displayed frame image is acquired according to a received triggering instruction including a frame rate of the current to-be-displayed frame image.

S202, the scale factor corresponding to the current to-be-displayed frame image is acquired by looking up a pre-established corresponding relationship table of frame rates and scale factors according to the acquired frame rate of the current to-be-displayed frame image.

In the above embodiment, the switching of the frame rates of the display panel is triggered by the triggering instruction.

In some embodiments, if a user wants the display panel to perform displaying at a frame rate of 90 Hz, the user triggers the display panel to send the triggering instruction including the frame rate of the current to-be-displayed frame image.

After receiving the triggering instruction, the display panel performs the displaying at the frame rate of 90 Hz, and looks up the pre-established corresponding relationship table of frame rates and scale factors to acquire the scale factor corresponding to the frame rate of 90 Hz.

Figure 3:
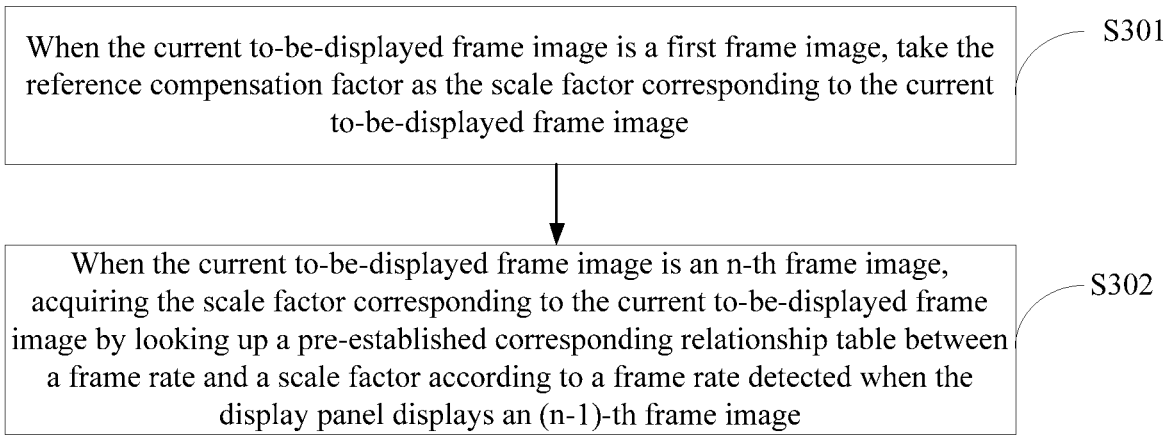
FIG. 3 is a schematic flow diagram of acquiring a scale factor corresponding to the current to-be-displayed frame image provided by another embodiment of the present disclosure.

In another optional embodiment, in the luminance compensation method provided by the embodiment of the present disclosure, the process of acquiring the scale factor corresponding to the current to-be-displayed frame image is as shown in FIG. 3.

FIG. 3 is a schematic flow diagram of acquiring the scale factor corresponding to the current to-be-displayed frame image provided by another embodiment of the present disclosure, including that the following operations.

S301, when the current to-be-displayed frame image is a first frame image, the reference compensation factor is taken as the scale factor corresponding to the current to-be-displayed frame image.

S302, when the current to-be-displayed frame image is the n-th frame image, the scale factor corresponding to the current to-be-displayed frame image is acquired by looking up the pre-established corresponding relationship table of frame rates and scale factors according to a frame rate detected when the display panel displays the (n−1)-th frame image, where n is any integer greater than 1.

In the above embodiment, the display panel detects a frame rate of a display image in real time. After the frame rate is detected, for example, if the detected frame rate is 90 HZ, the pre-established corresponding relationship table of frame rates and scale factors is looked up to acquire a scale factor corresponding to the frame rate of 90 HZ. From the second frame image, the frame rate of the current to-be-displayed frame image refers to a frame rate detected when the previous frame image is displayed, and the scale factor corresponding to the frame rate of 90 HZ is acquired by looking up the pre-established corresponding relationship table of frame rates and scale factors. For the first frame image, the reference compensation factor is directly taken as the scale factor corresponding to the current to-be-displayed frame image.

In some embodiments, the frame rate of a display image may be determined through a method of detecting a TE signal or other methods, and there is no limitation herein.

Figure 4:
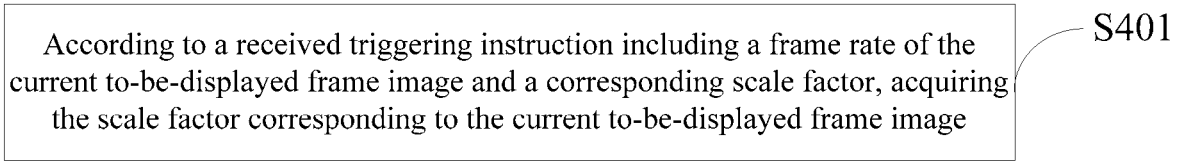
FIG. 4 is a schematic flow diagram of acquiring a scale factor corresponding to the current to-be-displayed frame image provided by a further embodiment of the present disclosure.

In a further optional embodiment, in the luminance compensation method provided by the embodiment of the present disclosure, the process of acquiring the scale factor corresponding to the current to-be-displayed frame image is as shown in FIG. 4.

FIG. 4 is a schematic flow diagram of acquiring the scale factor corresponding to the current to-be-displayed frame image provided by a further embodiment of the present disclosure, including that the following operations.

S401, the scale factor corresponding to the current to-be-displayed frame image is acquired according to the received triggering instruction including the frame rate of the current to-be-displayed frame image and a corresponding scale factor.

The scale factor, corresponding to the frame rate of the current to-be-displayed frame image, in the triggering instruction is acquired in advance according to the pre-established corresponding relationship table of frame rates and scale factors.

In the above embodiment, the switching of the frame rates of the display panel is triggered by the triggering instruction. In one embodiment, if a user wants the display panel to perform displaying at a frame rate of 90 Hz, the user triggers the display panel to send the triggering instruction including the frame rate of the current to-be-displayed frame image.

After receiving the instruction, the display panel performs the displaying at the frame rate of 90 HZ. Furthermore, the triggering instruction also includes the frame rate of the current to-be-displayed frame image, so that the scale factor corresponding to the current to-be-displayed frame image may be acquired after the triggering instruction is received. Of course, the scale factor, corresponding to the frame rate of the current to-be-displayed frame image, in the triggering instruction needs to be acquired in advance according to the pre-established corresponding relationship table of the frame rates and the scale factors.

Further, how to pre-establish the corresponding relationship table of frame rates and scale factors is described in detail below through some embodiments.

Figure 5:
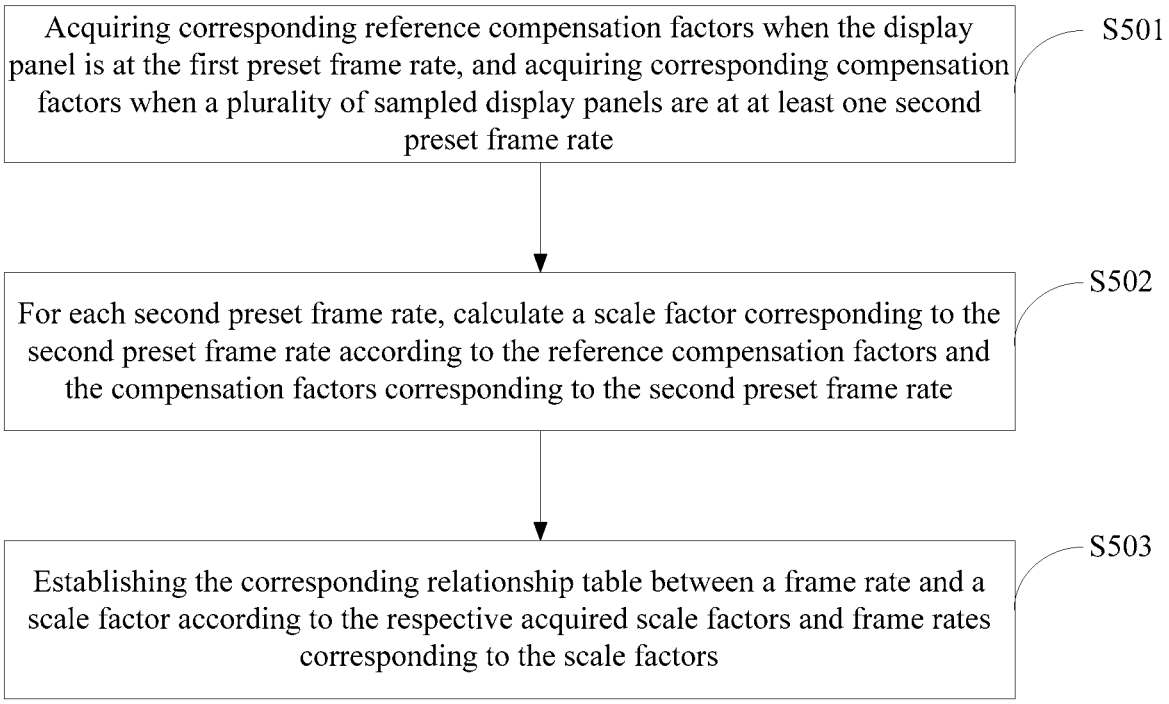
FIG. 5 is a schematic flow diagram of pre-establishing a corresponding relationship table provided by one embodiment of the present disclosure.

In some embodiments, in the luminance compensation method provided by the embodiment of the present disclosure, as shown in FIG. 5, FIG. 5 is a schematic flow diagram of pre-establishing the corresponding relationship table provided by one embodiment of the present disclosure.

The pre-established corresponding relationship table of frame rates and scale factors is acquired through the following operations.

S501, corresponding reference compensation factors when the display panel is at the first preset frame rate are acquired, and corresponding compensation factors when a plurality of sampled display panels are at one or more second preset frame rates are acquired.

S502, for each second preset frame rate, a scale factor corresponding to the second frame rate is calculated according to the reference compensation factors and respective compensation factors corresponding to the sampled display panels at the second preset frame rate.

S503, the corresponding relationship table of frame rates and scale factors is established according to all the acquired scale factors and frame rates corresponding to the scale factors, where in the corresponding relationship table, the scale factor corresponding to the first preset frame rate is 1, and for each second preset frame rate, a larger frame rate value corresponds to a larger scale factor.

In the related art, compensation factors corresponding to all the frame rates of the display panel need to be captured respectively for the display panel, so that the production time of a production line is relatively long.

In the luminance compensation method provided by the embodiment of the present disclosure, for the compensation factors corresponding to all the second preset frame rates, only some sampled display panels in the same batch of display panels need to be selected for capturing, and a finally obtained target compensation factor is applicable to every display panel of the same batch, so that the production time of the production line may be greatly shortened.

At present, a frame rate commonly used in the display panel is still generally 60 HZ.

Therefore, in the luminance compensation method according to some embodiments of the present disclosure, the first preset frame rate is 60 HZ. Of course, frame rates of other frequencies may also be used as the first preset frame rate, and there is no limitation herein.

Further, there are also display panels of 30 HZ, 90 HZ, 120 HZ, 144 HZ or 240 HZ in addition to the display panel of 60 HZ. Therefore, in the luminance compensation method according to some embodiments of the present disclosure, the second preset frame rate includes at least one of 30 HZ, 90 HZ, 120 HZ, 144 HZ or 240 HZ, and there is no limitation herein.

Further, in the luminance compensation method provided by the embodiment of the present disclosure, the same frame rate may correspond to one scale factor, that is, all gray scales correspond to one scale factor.

In some embodiments, one frame rate may also correspond to a plurality of scale factors, that is, different gray scale ranges correspond to different scale factors.

In some embodiments, a low gray scale range corresponds to one scale factor, a medium gray scale range corresponds to one scale factor, and a high gray scale range corresponds to one scale factor, so that different scale factors are used for different gray scale ranges to generate the target compensation factors, which may further enhance the compensation effect.

In some embodiments, when different gray scale ranges of one frame rate correspond to different scale factors, in the luminance compensation method provided by the embodiment of the present disclosure, the operation that the corresponding reference compensation factors when the display panel is at the first preset frame rate are acquired, and the corresponding compensation factors when the plurality of sampled display panels are at the one or more second preset frame rates are acquired include that: the corresponding reference compensation factors when the display panel is at the first preset frame rate are acquired, and the compensation factors corresponding to different gray scale ranges when the plurality of sampled display panels are at the one or more second preset frame rates are acquired.

The operation that for each second preset frame rate, the scale factor corresponding to the second frame rate is calculated according to the reference compensation factors and all compensation factors corresponding to the second frame rate includes that: for each second preset frame rate, scale factors respectively corresponding to different gray scale ranges at the second frame rate are calculated according to the reference compensation factors and compensation factors respectively corresponding to the different gray scale ranges at the second frame rate.

The operation that the corresponding relationship table of frame rates and scale factors is established according to all the acquired scale factors and frame rates corresponding to the scale factors includes that: the corresponding relationship table of frame rates and scale factors is established according to all the acquired compensation factors corresponding to different gray scale ranges and frame rates corresponding to the scale factors, where in the corresponding relationship table, the different gray scale ranges at each second preset frame rate respectively correspond to different scale factors.

Figure 6:
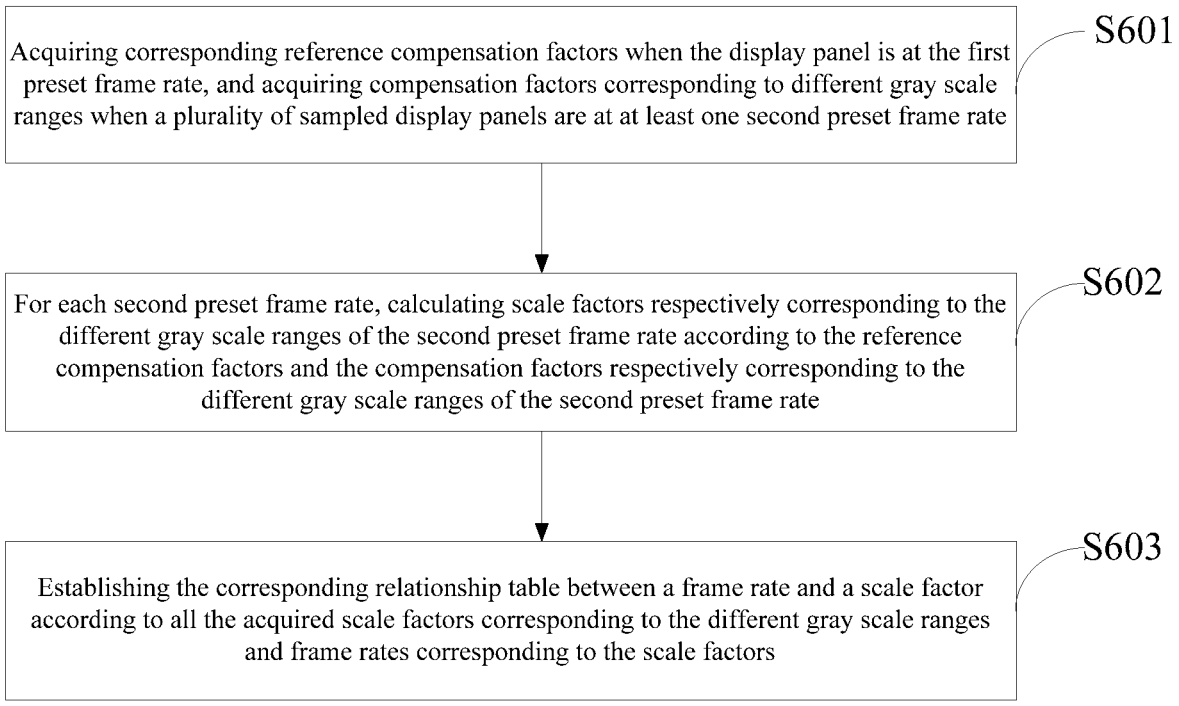
FIG. 6 is a schematic flow diagram of pre-establishing a corresponding relationship table provided by another embodiment of the present disclosure.

That is, when different gray scale ranges of one frame rate correspond to different scale factors, in the luminance compensation method provided by the embodiment of the present disclosure, as shown in FIG. 6, FIG. 6 is a schematic flow diagram of pre-establishing the corresponding relationship table provided by a further embodiment of the present disclosure.

The pre-established corresponding relationship table of frame rates and scale factors is acquired through the following operations.

S601, corresponding reference compensation factors when the display panel is at the first preset frame rate are acquired, and corresponding compensation factors corresponding to different gray scale ranges when a plurality of sampled display panels are at one or more second preset frame rates are acquired.

S602, for each second preset frame rate, scale factors respectively corresponding to the different gray scale ranges of the second frame rate are calculated according to the reference compensation factors and the compensation factors respectively corresponding to the different gray scale ranges at the second frame rate.

S603, the corresponding relationship table of frame rates and scale factors is established according to the acquired compensation factors corresponding to the different gray scale ranges and frame rates corresponding to the scale factors, where in the corresponding relationship table, the different gray scale ranges at each second preset frame rate respectively correspond to different scale factors.

In some embodiments, a relatively low gray scale is generally easy to overcompensate. Since a relatively large gray scale is brighter, a luminance difference is not easily identified by human eyes, and a range from the minimum gray scale to the maximum gray scale may be divided into a plurality of different gray scale ranges. The scale factors corresponding to the low gray scale range and the high gray scale range are less than the scale factor corresponding to the medium gray scale range.

Figure 7:
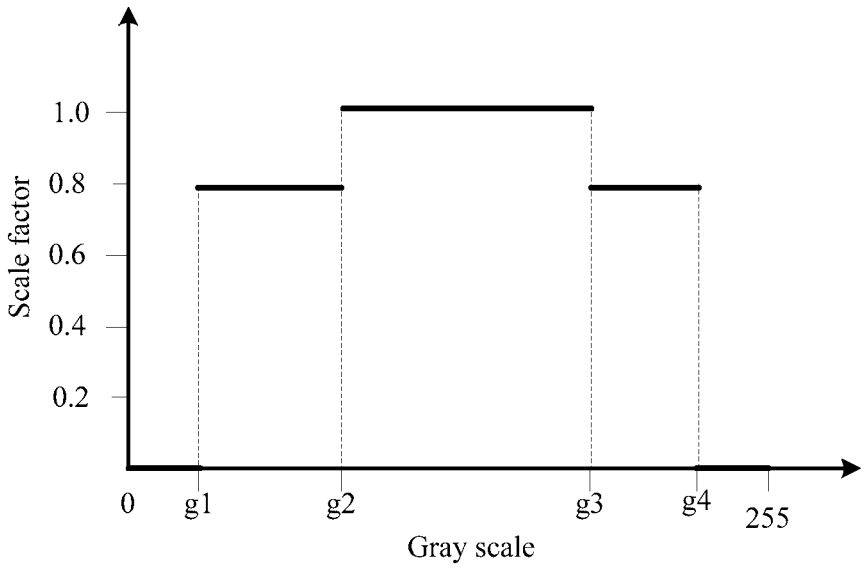
FIG. 7 is a schematic diagram illustrating different gray scale ranges and scale factors corresponding thereto provided by an embodiment of the present disclosure.

In some embodiments, different gray scale ranges and scale factors corresponding to the gray scale ranges are as shown in FIG. 7. If the scale factor corresponding to the gray scale range from g2 to g3 is 1, the scale factor corresponding to the gray scale range from 0 to g1 is 0, and the scale factor corresponding to the gray scale range from g1 to g2 is 0.8, and the scale factor corresponding to the gray scale range from g3 to g4 is 0.8, and the scale factor corresponding to g4 to 255 is 0. FIG. 7 is merely for illustration. Specifically, the scale factors corresponding to different gray scales are obtained by detecting different panels.

Figure 8:
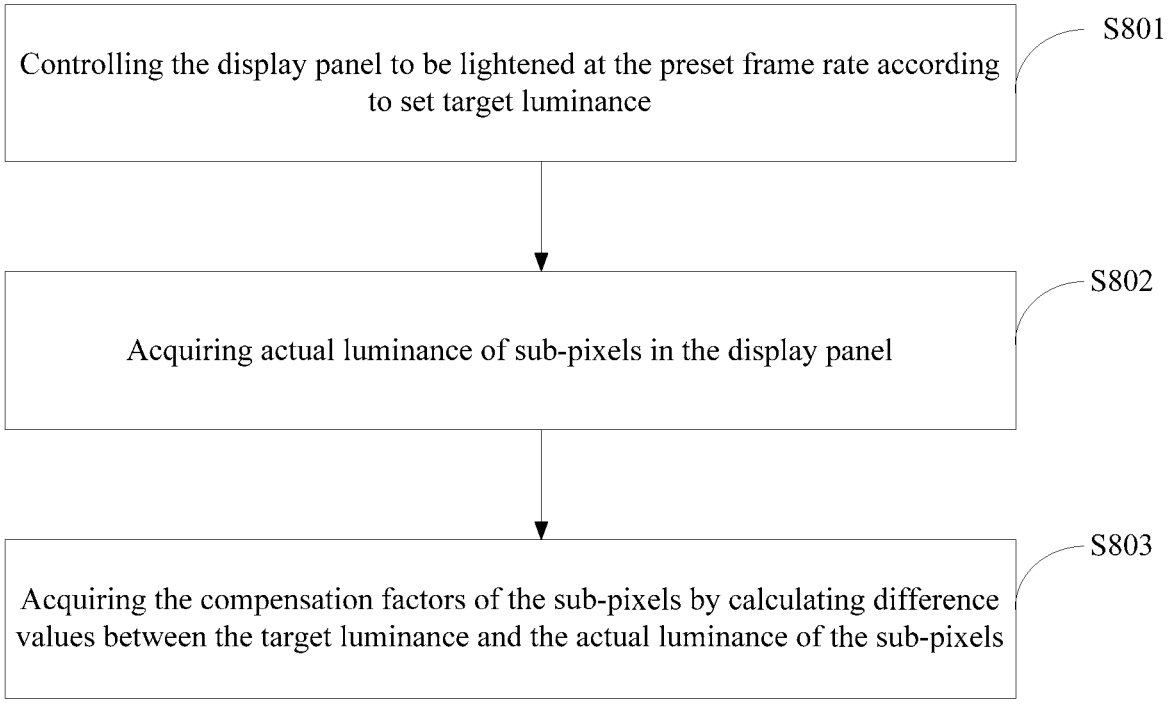
FIG. 8 is a schematic flow diagram of acquiring a compensation factor corresponding to a preset frame rate provided by one embodiment of the present disclosure.

In one embodiment, in the luminance compensation method provided by the embodiment of the present disclosure, as shown in FIG. 8, FIG. 8 is a schematic flow diagram of acquiring compensation factors corresponding to a preset frame rate provided by one embodiment of the present disclosure.

The acquisition of the compensation factors corresponding to the preset frame rate includes the following operations.

S801, the display panel is controlled to be lightened at a preset frame rate according to set target luminance.

S802, actual luminance of sub-pixels in the display panel is acquired.

S803, the compensation factors of the sub-pixels are acquired by calculating difference values between the target luminance and the actual luminance of the sub-pixels.

In some embodiments, when different gray scale ranges of one frame rate correspond to different scale factors, the display panel is controlled to select the set target luminance in the corresponding gray scale range, to be turned on at the preset frame rate. Other operations are all the same, and descriptions thereof are omitted herein.

It shall be noted that the preset frame rate mentioned in the embodiment of the present disclosure includes a first preset frame rate and a second preset frame rate.

Figure 9:
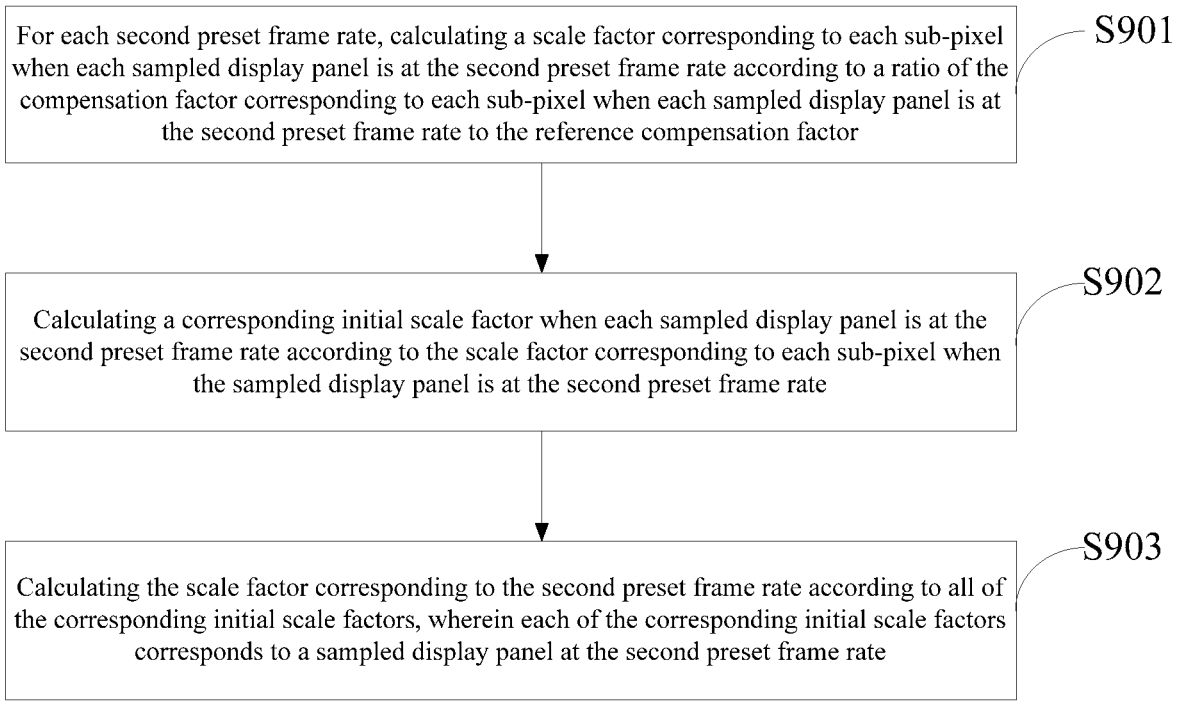
FIG. 9 is a schematic flow diagram of calculating a scale factor corresponding to a second preset frame rate provided by one embodiment of the present disclosure.

In some embodiments, in the luminance compensation method provided by the embodiment of the present disclosure, as shown in FIG. 9, FIG. 9 is a schematic flow diagram of calculating the scale factor corresponding to the second frame rate provided by one embodiment of the present disclosure.

The operation that for each second preset frame rate, the scale factor corresponding to the second frame rate is calculated according to the reference compensation factors and all compensation factors corresponding to the second frame rate includes the following operations.

S901, for each second preset frame rate, a scale factor corresponding to each sub-pixel when each sampled display panel is at the second preset frame rate is calculated according to a ratio of the compensation factor corresponding to each sub-pixel when each sampled display panel is at the second preset frame rate to the reference compensation factor.

S902, a corresponding initial scale factor when each sampled display panel is at the second preset frame rate is calculated according to the scale factor corresponding to each sub-pixel when the sampled display panel is at the second preset frame rate.

S903, a final scale factor corresponding to the second preset frame rate is calculated according to all of the corresponding initial scale factors, where each of the corresponding initial scale factors corresponds to a sampled display panel at the second preset frame rate.

In some embodiments, in the luminance compensation method provided by the embodiment of the present disclosure, the operation that the corresponding initial scale factor when each sampled display panel is at the second preset frame rate is calculated according to the scale factors corresponding to all sub-pixels when the sampled display panel is at the second preset frame rate includes that: the scale factors corresponding to all sub-pixels when the sampled display panel is at the second preset frame rate are subjected to weighted averaging to obtain the corresponding initial scale factor when the sampled display panel is at the second preset frame rate.

In some embodiments, the corresponding initial scale factor when each sampled display panel is at the second preset frame rate may also be calculated by other methods. In one embodiment, the scale factors with closer data are selected to be subjected to the weighted averaging, there is no limitation herein.

In some embodiments, in the luminance compensation method provided by the embodiment of the present disclosure, the operation that the final scale factor corresponding to the second preset frame rate is calculated according to the corresponding initial scale factors when all sampled display panels are at the second preset frame rate specifically includes that: the corresponding initial scale factors when all sampled display panels are at the second preset frame rate are subjected to the weighted averaging to obtain the final scale factor corresponding to the second preset frame rate.

In some embodiments, the final corresponding scale factor when each sampled display panel is at the second preset frame rate may also be calculated by other methods. In one embodiment, the scale factors with closer data are selected to be subjected to the weighted averaging, there is no limitation herein.

In some embodiments, in the luminance compensation method provided by the embodiment of the present disclosure, the first preset frame rate being 60 HZ, the respective second preset frame rates being 30 HZ, 90 HZ, 120 HZ, 144 HZ and 240 HZ, and scale factors corresponding to the second preset frame rates being 0.6, 1.2, 1.3, 1.4 and 1.6 respectively are taken as an example, and the established corresponding relationship table of frame rates and the scale factors is as shown in Table 1.

TABLE 1

| Frame rates | Scale factors |
|---|---|
| 30 HZ | 0.6 |
| 60 HZ | 1.0 |
| 90 HZ | 1.2 |
| 120 HZ | 1.3 |
| 144 HZ | 1.4 |
| 240 HZ | 1.6 |

In some embodiments, in the luminance compensation method provided by the embodiment of the present disclosure, the operation that the corresponding relationship table of frame rates and scale factors is established according to the respective acquired scale factors and frame rates corresponding to the scale factors includes the following operations.

All the preset frame rates are arranged according to frame rate values from small to large.

A scale factor corresponding to other frame rate X located between two adjacent preset frame rates is k, and k satisfies:

$$k = k_1 + \frac{X - X_1}{X_2 - X_1}(k_2 - k_1).$$

$X_1$ represents a frame rate with a smaller frame rate value in the two adjacent preset frame rates; $X_2$ represents a frame rate with a larger frame rate value in the two adjacent preset frame rates; $k_1$ represents a scale factor corresponding to $X_1$; and $k_2$ represents a scale factor corresponding to $X_2$.

Figure 10:
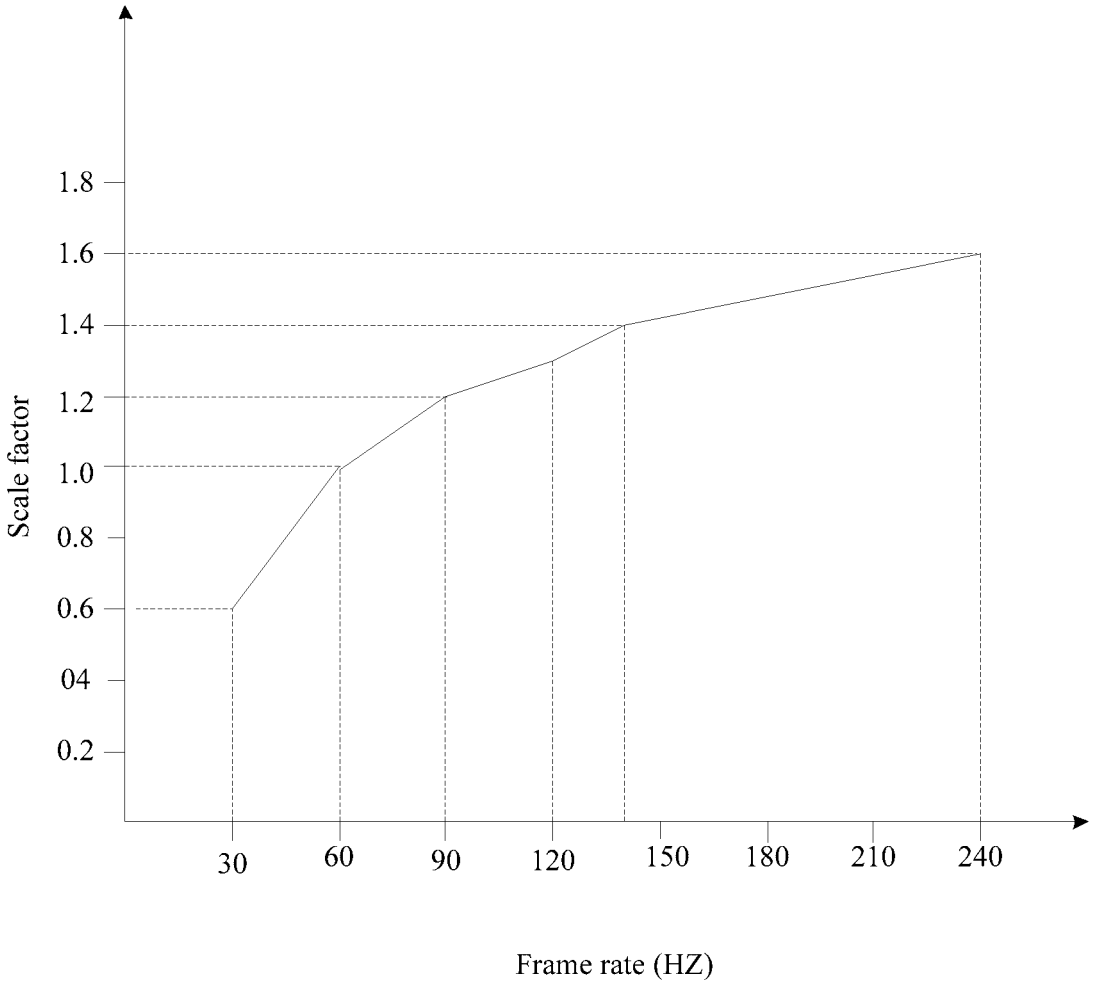
FIG. 10 is a schematic diagram illustrating a corresponding relationship table of frame rates and scale factors provided by one embodiment of the present disclosure.

In some embodiments, the first preset frame rate being 60 HZ, the respective second preset frame rates being 30 HZ, 90 HZ, 120 HZ, 144 HZ and 240 HZ, and scale factors corresponding to the second preset frame rates being 0.6, 1.2, 1.3, 1.4 and 1.6 respectively are still taken as an example, and the established corresponding relationship table of frame rates and scale factors is as shown in FIG. 10, and FIG. 10 is a schematic diagram illustrating the corresponding relationship table of frame rates and scale factors provided by one embodiment of the present disclosure.

In some embodiments, in the luminance compensation method provided by the embodiment of the present disclosure, the operation that the corresponding relationship table of frame rates and scale factors is established according to all the acquired scale factors and frame rates corresponding to the scale factors includes that: a range between the minimum frame rate and the maximum frame rate which may be displayed by the display panel is divided into a plurality of frame rate ranges, and each frame rate range includes one preset frame rate; each frame rate range corresponds to one scale factor, and the scale factor corresponding to the frame rate range is equal to a scale factor corresponding to a preset frame rate within the frame rate range.

Figure 11:
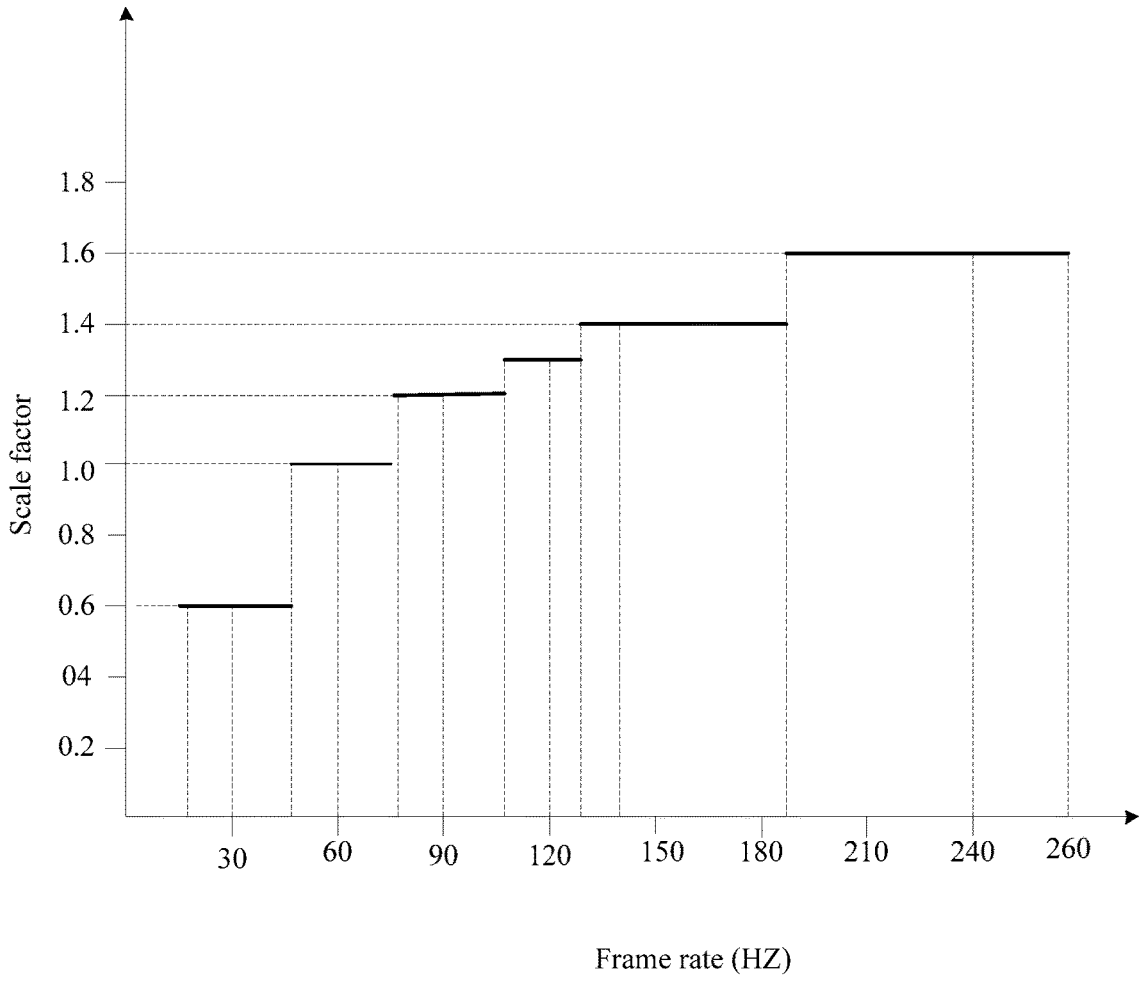
FIG. 11 is a schematic diagram illustrating a corresponding relationship table of frame rates and scale factors provided by one embodiment of the present disclosure.

In some embodiments, the first preset frame rate being 60 HZ, the respective second preset frame rates being 30 HZ, 90 HZ, 120 HZ, 144 HZ and 240 HZ, and scale factors corresponding to the second preset frame rates being 0.6, 1.2, 1.3, 1.4 and 1.6 respectively are still taken as an example, and the established corresponding relationship table of the frame rates and the scale factors is as shown in FIG. 11, and FIG. 11 is a schematic diagram illustrating the corresponding relationship table of frame rates and scale factors provided by one embodiment of the present disclosure.

In specific implementation, for each frame rate range, it may be set that an included preset frame rate is located in the middle of the frame rate range.

In some embodiments, when each frame rate corresponds to a plurality of scale factors, in the luminance compensation method provided by the embodiment of the present disclosure, the operation that the reference compensation factor corresponding to each sub-pixel in the RAM is multiplied by the scale factor to generate the target compensation factor corresponding to the current to-be-displayed frame image includes that: the reference compensation factor corresponding to each sub-pixel stored in the RAM is multiplied by the scale factor corresponding to a gray scale range to, according to the gray scale range to which each sub-pixel in the current to-be-displayed frame image belongs, to generate the target compensation factor corresponding to the current to-be-displayed frame image.

In one embodiment, for the frame rate of 90 HZ, a scale factor corresponding to a low gray scale range is 1.15, a scale factor corresponding to a medium gray scale range is 1.2, and a scale factor corresponding to a high gray scale range is 1.16.

During generation of the target compensation factor corresponding to the current to-be-displayed frame image, a target compensation factor corresponding to a sub-pixel belonging to the low gray scale range in the current to-be-displayed frame image is obtained by multiplying the reference compensation factor corresponding to this sub-pixel by 1.15, a target compensation factor corresponding to a sub-pixel belonging to the medium gray scale range in the current to-be-displayed frame image is obtained by multiplying the reference compensation factor corresponding to this sub-pixel by 1.2, and a target compensation factor corresponding to a sub-pixel belonging to the high gray scale range in the current to-be-displayed frame image is obtained by multiplying the reference compensation factor corresponding to this sub-pixel by 1.16.

Figure 12:
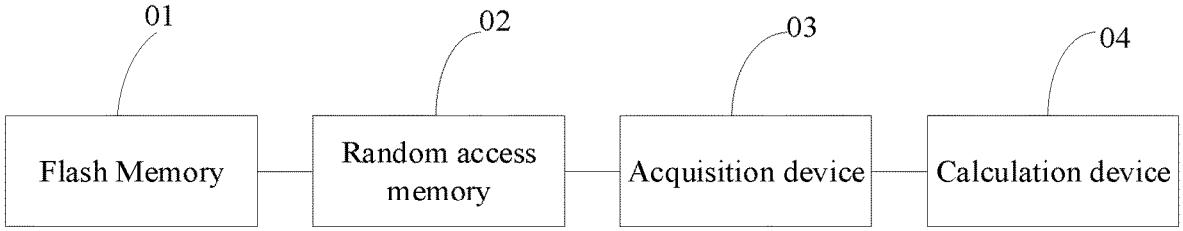
FIG. 12 is a schematic structural diagram of a luminance compensation circuit provided by an embodiment of the present disclosure.

Based on the same inventive concept, an embodiment of the present disclosure further provides a luminance compensation circuit of an OLED display panel, as shown in FIG. 12.

FIG. 12 is a schematic structural diagram of the luminance compensation circuit provided by the embodiment of the present disclosure, including a flash 01, a random access memory (RAM) 02, an acquisition device 03 and a calculation device 04.

The flash 01 is configured to store a reference compensation factor corresponding to each sub-pixel in a display panel, where the reference compensation factor is a corresponding luminance compensation factor when the display panel performs displaying according to a first preset frame rate.

The RAM 02 is configured to store the reference compensation factor acquired from the flash 01 when the display panel starts the displaying.

The acquisition device 03 is configured to acquire a scale factor corresponding to the current to-be-displayed frame image.

The calculation device 04 is configured to multiply the reference compensation factor corresponding to each sub-pixel by the scale factor to generate a target compensation factor corresponding to the current to-be-displayed frame image, to enable the display panel to perform the displaying according to the target compensation factor.

The luminance compensation circuit provided by the embodiment of the present disclosure stores the reference compensation factor corresponding to each sub-pixel in the display panel by using the flash, stores the reference compensation factor acquired from the flash when the display panel starts the displaying by using the RAM, acquires the scale factor corresponding to the current to-be-displayed frame image by using the acquisition device, and multiplies the reference compensation factor corresponding to each sub-pixel by the scale factor through the calculation device to generate the target compensation factor corresponding to the current to-be-displayed frame image, to enable the display panel to perform the displaying according to the target compensation factor.

According to the luminance compensation circuit, regardless of the number of frame rates supported by the display panel, since the RAM and the flash only need to store the reference compensation factors, the size can be reduced by at least twice compared to the size in the prior art. Furthermore, during the switching of the frame rates, the target compensation factor may be obtained by only multiplying the reference compensation factors by the scale factor, without reloading Demura compensation factors, so the switching time is short, and no screen off is required.

In some embodiments, the calculation device may be an element, such as a multiplier, to realize a multiplying function, and it is not limited herein.

Figure 13:
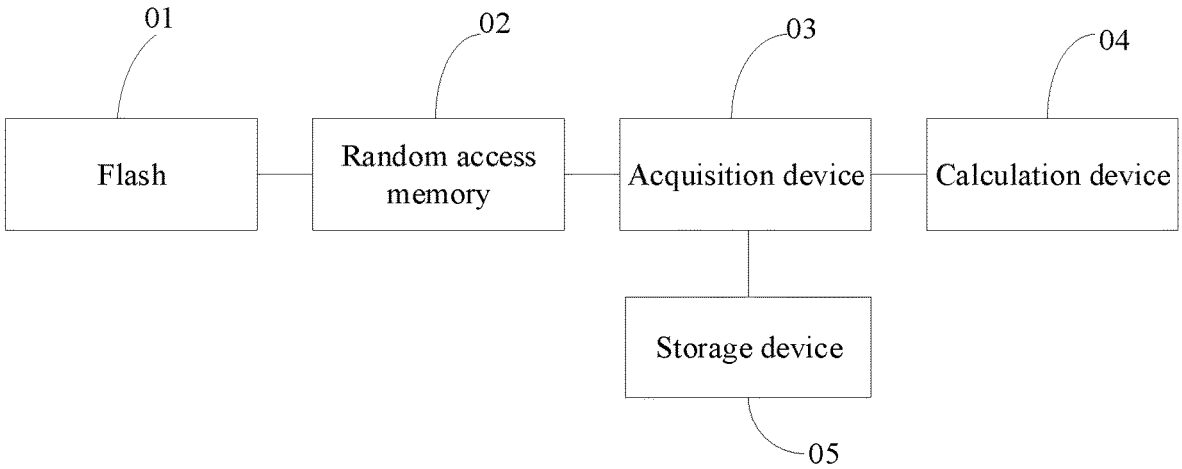
FIG. 13 is a schematic structural diagram of another luminance compensation circuit provided by an embodiment of the present disclosure.

In some embodiments, in the luminance compensation circuit provided by the embodiment of the present disclosure, as shown in FIG. 13, FIG. 13 is a schematic structural diagram of another luminance compensation circuit provided by an embodiment of the present disclosure. The luminance compensation circuit further includes a storage device 05.

The storage device 05 is configured to store a pre-established corresponding relationship table of frame rates and scale factors.

The acquisition device 03 is specifically configured to acquire the scale factor corresponding to the current to-be-displayed frame image according to the corresponding relationship table stored in the storage device 05.

In some embodiments, in the luminance compensation circuit provided by the embodiment of the present disclosure, the pre-established corresponding relationship table of frame rates and scale factors is acquired by the following operations.

Corresponding reference compensation factors when the display panel is at the first preset frame rate are acquired, and corresponding compensation factors when a plurality of sampled display panels are at one or more second preset frame rates are acquired.

For each second preset frame rate, a scale factor corresponding to the second preset frame rate is calculated according to the reference compensation factors and respective compensation factors corresponding to the second respective frame rate.

The corresponding relationship table of frame rates and scale factors is established according to the respective acquired scale factors and frame rates corresponding to the scale factors, where in the corresponding relationship table, the scale factor corresponding to the first preset frame rate is 1, and for each second preset frame rate, a larger frame rate value corresponds to a larger scale factor.

In some embodiments, in the luminance compensation circuit provided by the embodiment of the present disclosure, as shown in the figure, acquisition of compensation factors corresponding to a preset frame rate includes that: the display panel is controlled to be lightened at the preset frame rate according to set target luminance; actual luminance of sub-pixels in the display panel is acquired; the compensation factors of the sub-pixels are acquired by calculating difference values between the target luminance and the actual luminance of the sub-pixels.

In some embodiments, the problem solving principle of the luminance compensation circuit provided by the embodiment of the present disclosure is similar to that of the above-mentioned luminance compensation method, so that the implementation of the luminance compensation circuit may refer to the implementation of the above-mentioned luminance compensation method, and repeated descriptions are omitted.

Based on the same inventive concept, an embodiment of the present disclosure further provides a display device, including an OLED display panel and any one of the luminance compensation circuit provided by the embodiment of the present disclosure.

Figure 14:
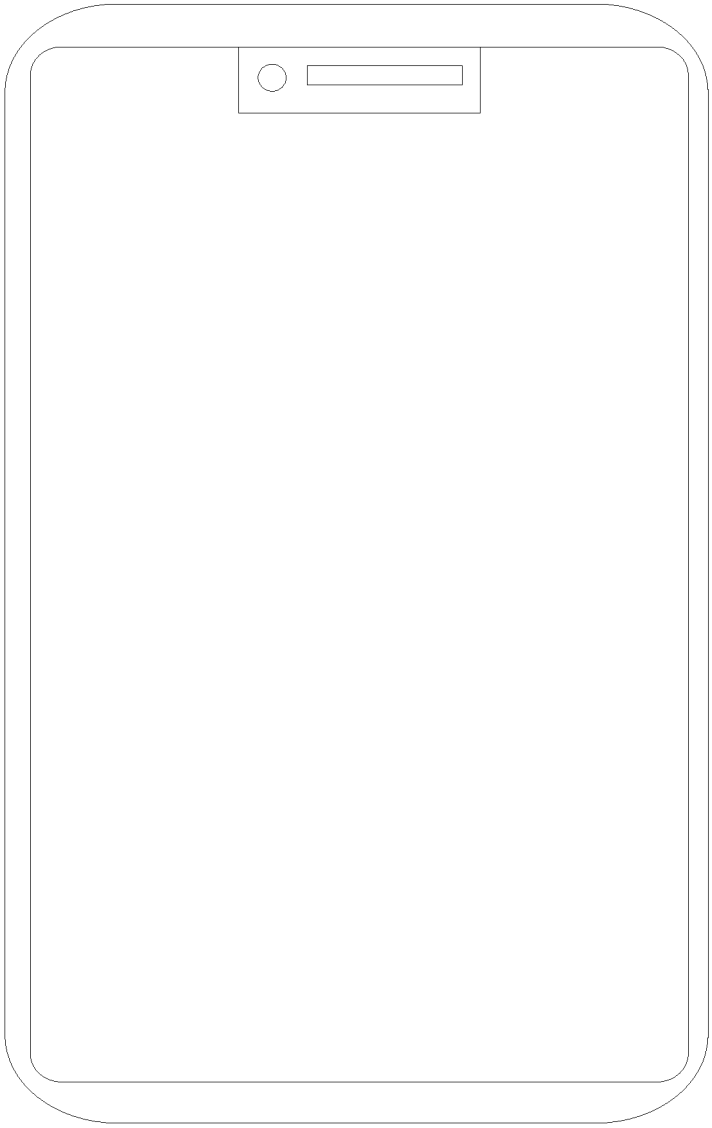
FIG. 14 is a structural schematic diagram of a display device provided by an embodiment of the present disclosure.

In some embodiments, the display device may be any product or device having a display function, such as a mobile phone, a tablet computer, a television, a display, a notebook computer, a digital photo frame and a navigator, as shown in FIG. 14. The implementation of the display device may refer to the embodiment of the above-mentioned display panel, and repeated descriptions are omitted.

According to the luminance compensation method, the luminance compensation circuit and the display device which are provided by the embodiments of the present disclosure, when the display panel starts the displaying, the reference compensation factor corresponding to each sub-pixel in the display panel is acquired from the flash, then the acquired reference compensation factor corresponding to each sub-pixel is stored in the RAM, and finally the scale factor corresponding to the current to-be-displayed frame image is acquired, and the reference compensation factor corresponding to each sub-pixel and stored in the RAM is multiplied by the scale factor to generate the target compensation factor corresponding to the current to-be-displayed frame image, so that the display panel performs the displaying according to the target compensation factor.

By adopting the compensation method, regardless of the number of frame rates supported by the display panel, since the RAM and the flash only need to store the reference compensation factors, the size can be reduced by at least twice compared to the size in an existing driving method. Furthermore, during the switching of the frame rates, the target compensation factor may be obtained by only multiplying the reference compensation factors by the scale factor, without reloading Demura compensation factors, so the switching time is short, and no screen off is required.

What is claimed is:

1. A luminance compensation method of an Organic Light Emitting Diode (OLED) display panel, comprising:

acquiring a reference compensation factor corresponding to each sub-pixel in the display panel from a flash when the display panel starts displaying, wherein the reference compensation factor is a corresponding luminance compensation factor when the display panel performs displaying according to a first preset frame rate;

storing the acquired reference compensation factor corresponding to each sub-pixel into a random access memory (RAM);

acquiring a scale factor corresponding to a current to-be-displayed frame image;

generating a target compensation factor corresponding to the current to-be-displayed frame image by multiplying the reference compensation factor corresponding to each sub-pixel stored in the RAM by the scale factor; and displaying according to the target compensation factor;

wherein the acquiring the scale factor corresponding to the current to-be-displayed frame image comprises:

according to a received triggering instruction including a frame rate of the current to-be-displayed frame image, acquiring the frame rate of the current to-be-displayed frame image; and acquiring the scale factor corresponding to the current to-be-displayed frame image by looking up a pre-established corresponding relationship table between a frame rate and a scale factor according to the acquired frame rate of the current to-be-displayed frame image.

2. The luminance compensation method according to claim 1, wherein establishing the corresponding relationship table between a frame rate and a scale factor comprises:

acquiring corresponding reference compensation factors when the display panel is at the first preset frame rate, and acquiring corresponding compensation factors when a plurality of sampled display panels are at one or more second preset frame rates;

for each second preset frame rate, calculating a scale factor corresponding to the second preset frame rate according to the reference compensation factors and respective compensation factors corresponding to the sampled display panels at the second preset frame rate; and establishing the corresponding relationship table between a frame rate and a scale factor according to the respective acquired scale factors and frame rates thereof, wherein in the corresponding relationship table, the scale factor corresponding to the first preset frame rate is 1, and for each second preset frame rate, a larger frame rate value corresponds to a larger scale factor.

3. The luminance compensation method according to claim 2, wherein acquiring the compensation factors corresponding to the preset frame rate comprises:

controlling the display panel to be lightened at the preset frame rate according to set target luminance;

acquiring actual luminance of sub-pixels in the display panel; and acquiring the compensation factors of the sub-pixels by calculating difference values between the target luminance and the actual luminance of the sub-pixels.

4. The luminance compensation method according to claim 3, wherein the first preset frame rate is 60 HZ.

5. The luminance compensation method according to claim 3, wherein the second preset frame rate comprises at least one of 30 HZ, 90 HZ, 120 HZ, 144 HZ or 240 HZ.

6. The luminance compensation method according to claim 2, wherein for each second preset frame rate, calculating the scale factor corresponding to the second preset frame rate according to the reference compensation factors and the compensation factors corresponding to the second preset frame rate comprises:

for each second preset frame rate, calculating a scale factor corresponding to each sub-pixel when each sampled display panel is at the second preset frame rate, according to a ratio of the compensation factor corresponding to each sub-pixel when each sampled display panel is at the second preset frame rate to the reference compensation factor;

calculating a corresponding initial scale factor when each sampled display panel is at the second preset frame rate according to the scale factor corresponding to each sub-pixel when the sampled display panel is at the second preset frame rate; and calculating the scale factor corresponding to the second preset frame rate according to all of the corresponding initial scale factors, wherein each of the corresponding initial scale factors corresponds to a sampled display panel at the second preset frame rate.

7. The luminance compensation method according to claim 6, wherein the calculating the corresponding initial scale factor when each sampled display panel is at the second preset frame rate according to the scale factors corresponding to all sub-pixels when the sampled display panel is at the second preset frame rate comprises:

performing weighted averaging on the scale factors corresponding to all sub-pixels when the sampled display panel is at the second preset frame rate to obtain the corresponding initial scale factor when the sampled display panel is at the second preset frame rate.

8. The luminance compensation method according to claim 6, wherein the calculating the scale factor corresponding to the second preset frame rate according to the corresponding initial scale factors when all sampled display panels are at the second preset frame rate comprises:

performing weighted averaging on the corresponding initial scale factors when all sampled display panels are at the second preset frame rate to obtain the scale factor corresponding to the second preset frame rate.

9. The luminance compensation method according to claim 2, wherein the establishing the corresponding relationship table between a frame rate and a scale factor according to the respective acquired scale factors and frame rates thereof comprises:

arranging all the preset frame rates according to frame rate values from small to large, wherein a scale factor corresponding to other frame rate X located between two adjacent preset frame rates is k, and k satisfies:

$$k = k_1 + \frac{X - X_1}{X_2 - X_1}(k_2 - k_1);$$

$X_1$ represents a frame rate with a smaller frame rate value in the two adjacent preset frame rates; $X_2$ represents a frame rate with a larger frame rate value in the two adjacent preset frame rates; $k_1$ represents a scale factor corresponding to $X_1$; and $k_2$ represents a scale factor corresponding to $X_2$.

10. The luminance compensation method according to claim 2, wherein the establishing the corresponding relationship table between a frame rate and a scale factor according to the respective acquired scale factors and frame rates thereof comprises:

dividing a range between a minimum frame rate and a maximum frame rate that are displayed by the display panel into a plurality of frame rate ranges;

wherein each frame rate range includes one preset frame rate; each frame rate range corresponds to one scale factor; and the scale factor corresponding to the frame rate range is equal to a scale factor corresponding to a preset frame rate within the frame rate range.

11. The luminance compensation method according to claim 2, wherein the acquiring the corresponding reference compensation factors when the display panel is at the first preset frame rate, and acquiring the corresponding compensation factors when the plurality of sampled display panels are at the one or more second preset frame rates comprises: acquiring the corresponding reference compensation factors when the display panel is at the first preset frame rate, and compensation factors corresponding to different gray scale ranges when the plurality of sampled display panels are at the one or more second preset frame rates;

for each second preset frame rate, calculating the scale factor corresponding to the second preset frame rate according to the reference compensation factors and respective compensation factors corresponding to the second preset frame rate comprises: for each second preset frame rate, calculating respective scale factors corresponding to different gray scale ranges at the second preset frame rate, according to the reference compensation factors and the respective compensation factors corresponding to the different gray scale ranges at the second preset frame rate; and the establishing the corresponding relationship table between a frame rate and a scale factor according to the respective acquired scale factors and frame rates thereof comprises: establishing the corresponding relationship table between a frame rate and a scale factor according to all the acquired compensation factors corresponding to different gray scale ranges and the frame rates thereof, wherein in the corresponding relationship table, the different gray scale ranges at each second preset frame rate respectively correspond to different scale factors.

12. The luminance compensation method according to claim 11, wherein the generating the target compensation factor corresponding to the current to-be-displayed frame image by multiplying the reference compensation factor corresponding to each sub-pixel stored in the RAM by the scale factor comprises:

generating the target compensation factor corresponding to the current to-be-displayed frame image by multiplying the reference compensation factor corresponding to each sub-pixel stored in the RAM by the scale factor corresponding to a gray scale range, according to the gray scale range to which each sub-pixel in the current to-be-displayed frame image belongs.

13. A luminance compensation circuit of an Organic Light Emitting Diode (OLED) display panel, comprising: a flash, a random access memory (RAM), an acquisition device and a calculation device, which are configured to perform the method of claim 1 by cooperating with each other.

14. The luminance compensation circuit according to claim 13, further comprising a storage device, wherein the storage device is configured to store a pre-established corresponding relationship table between a frame rate and a scale factor; and the acquisition device is configured to acquire the scale factor corresponding to the current to-be-displayed frame image according to the corresponding relationship table stored in the storage device.

15. The luminance compensation circuit according to claim 14, further comprising an establishing device configured to perform operations of:

acquiring corresponding reference compensation factors when the display panel is at the first preset frame rate, and acquiring corresponding compensation factors when a plurality of sampled display panels are at one or more second preset frame rates;

for each second preset frame rate, calculating a scale factor corresponding to the second preset frame rate according to the reference compensation factors and respective compensation factors corresponding to the sampled display panels at the second preset frame rate; and establishing the corresponding relationship table between a frame rate and a scale factor according to the respective acquired scale factors and frame rates thereof, wherein in the corresponding relationship table, the scale factor corresponding to the first preset frame rate is 1, and for each second preset frame rate, a larger frame rate value corresponds to a larger scale factor.

16. The luminance compensation circuit according to claim 15, wherein the establishing device is further configured to perform operations of:

controlling the display panel to be lightened at the preset frame rate according to set target luminance;

acquiring actual luminance of sub-pixels in the display panel; and acquiring the compensation factors of the sub-pixels by calculating difference values between the target luminance and the actual luminance of the sub-pixels.

17. A display device, comprising an Organic Light Emitting Diode (OLED) display panel and a luminance compensation circuit, wherein the luminance compensation circuit is configured to perform the method of claim 1.

18. A luminance compensation method of an Organic Light Emitting Diode (OLED) display panel, comprising:

acquiring a reference compensation factor corresponding to each sub-pixel in the display panel from a flash when the display panel starts displaying, wherein the reference compensation factor is a corresponding luminance compensation factor when the display panel performs displaying according to a first preset frame rate;

storing the acquired reference compensation factor corresponding to each sub-pixel into a random access memory (RAM);

acquiring a scale factor corresponding to a current to-be-displayed frame image;

generating a target compensation factor corresponding to the current to-be-displayed frame image by multiplying the reference compensation factor corresponding to each sub-pixel stored in the RAM by the scale factor; and displaying according to the target compensation factor;

wherein the acquiring the scale factor corresponding to the current to-be-displayed frame image comprises:

when the current to-be-displayed frame image is a first frame image, taking the reference compensation factor as the scale factor corresponding to the current to-be-displayed frame image; and when the current to-be-displayed frame image is an n-th frame image, acquiring the scale factor corresponding to the current to-be-displayed frame image by looking up a pre-established corresponding relationship table between a frame rate and a scale factor according to a frame rate detected when the display panel displays an (n-1)-th frame image, wherein n is an integer greater than 1.

19. A luminance compensation method of an Organic Light Emitting Diode (OLED) display panel, comprising:

acquiring a reference compensation factor corresponding to each sub-pixel in the display panel from a flash when the display panel starts displaying, wherein the reference compensation factor is a corresponding luminance compensation factor when the display panel performs displaying according to a first preset frame rate;

storing the acquired reference compensation factor corresponding to each sub-pixel into a random access memory (RAM);

acquiring a scale factor corresponding to a current to-be-displayed frame image;

generating a target compensation factor corresponding to the current to-be-displayed frame image by multiplying the reference compensation factor corresponding to each sub-pixel stored in the RAM by the scale factor; and displaying according to the target compensation factor;

wherein the acquiring the scale factor corresponding to the current to-be-displayed frame image comprises:

according to a received triggering instruction including a frame rate of the current to-be-displayed frame image and a corresponding scale factor, acquiring the scale factor corresponding to the current to-be-displayed frame image;

wherein the scale factor, corresponding to the frame rate of the current to-be-displayed frame image, in the triggering instruction is acquired in advance according to a pre-established corresponding relationship table between a frame rate and a scale factor.

* * * * *